United States Patent [19]

Stenzel

[11] Patent Number: 5,012,488

[45] Date of Patent: Apr. 30, 1991

[54] CRUCIBLE FOR INDUCTIVE HEATING

[75] Inventor: Otto W. Stenzel, Gründau, Fed. Rep. of Germany

[73] Assignee: Leybold Aktiengesellschaft, Fed. Rep. of Germany

[21] Appl. No.: 489,042

[22] Filed: Mar. 5, 1990

[30] Foreign Application Priority Data

Dec. 4, 1989 [DE] Fed. Rep. of Germany ..... 3940029

[51] Int. Cl.[5] ..... H05B 6/24

[52] U.S. Cl. ..... 373/156

[58] Field of Search ..... 373/156, 157, 158

[56] References Cited

U.S. PATENT DOCUMENTS

| | | | |
|---|---|---|---|
| 3,702,368 | 11/1972 | Hukin | 373/156 |
| 3,775,091 | 11/1973 | Clites et al. . | |
| 4,432,093 | 2/1984 | Reboux | 373/157 |
| 4,660,212 | 4/1987 | Boen et al. | 373/156 |
| 4,873,698 | 10/1989 | Boen | 373/156 |

FOREIGN PATENT DOCUMENTS 0276544 8/1988 European Pat. Off. .

518499 of 0000 Fed. Rep. of Germany .

*Primary Examiner*—Roy N. Envall, Jr.

*Attorney, Agent, or Firm*—Killworth, Gottman, Hagan & Schaeff

[57] ABSTRACT

The invention relates to a crucible for the inductive heating of materials. This crucible is subdivided into individual vertical segments wherein one segment (40) comprises at least two parts (43, 44) with different electrical conductivities and is layed out according to the condition $$\kappa < 2/(\pi f \mu_o b^2)$$

where $\kappa$ specific electrical conductivity of the part (43) with the poor conductivity f = frequency of the a.c current flowing through the induction coil (19)

$\mu_o$ = magnetic permeability in vacuo b = thickness of a segment.

11 Claims, 2 Drawing Sheets

CRUCIBLE FOR INDUCTIVE HEATING

BACKGROUND OF THE INVENTION

With ceramic crucibles in which metals are to be melted, one problem consists in that they indeed have a high melting temperature but in some cases they react with the melt or that pieces detach from the brittle crucible ceramic and float as inclusions in the melt. In contrast, crucibles of metal often do not tolerate the high melting temperatures without special measures In order to be able to melt materials with high melting temperatures in crucibles with relatively low melting temperatures, it is known to cool the crucibles with water so that they are kept at a temperature below their own melting points. However, now the melting material is cooled down relatively strongly because it is in contact with the cooled crucible.

A melting material with high temperature can be readily heated in a water-cooled metal crucible by means of inductive heating above the melting temperature of the crucible. Herein however, the problem of eddy current formation in the crucible occurs.

To decrease the eddy current losses caused hereby it is known to subdivide the crucible in many segments separated from each other by an insulating layer (DEP 518 499; USP 3 775 091, EP-A-0 276 544).

A fundamental disadvantage of the known cooled crucibles comprises in the high electrical losses which result from the eddy currents in the crucible wall and in the high heat losses which result from the heat flow from the melt into the cooled crucible wall. The herefrom resulting efficiency of the process can only be kept at an acceptable magnitude thereby that the melting process takes place at the maximum possible rate.

The invention therefore is based on the task of creating a cooled ceramic-free induction crucible with low electrical losses.

SUMMARY OF THE INVENTION

The advantage achieved with the invention comprises in particular in that the electrical efficiency of the coil-crucible arrangement becomes high through a special geometric configuration of the induction coil and crucible segments as well as through a special material selection for coil and crucible. This efficiency is herein defined as the ratio of the electric power released in the melt to the electric power supplied to the induction coil. Lesser crucible losses relieve the water cooling of the crucible and permit the use of a smaller current supply or increase the melting rate.

The crucible has a plurality of vertical segments which have at least two parts with different conductivity. The first part faces away from the material to be melted and is made of an electrically poor conductor. The second part faces toward the material to be melted. It is made of an electrically good conductor. The vertical segments are constructed so that the thickness satisfies the equation $$\kappa < \frac{2}{\pi f \mu_0 b^2}$$

where $\kappa$=specific electrical conductivity of the first part f=frequency of the a.c. current flowing through the induction coil $\mu_0$=magnetic permeability in vacuo b=thickness of the vertical segment.

An induction coil is wrapped around the vertical segments.

The first part of the vertical segment is preferably made of a non-conductor. The first part may be made of glass, a fiber-reinforced material, or ceramic, for example.

The second part of the vertical segment is preferably made of a material which has a heat conductivity of at least 80 Watt/m °K. The thickness of the second part is preferably $$t \leqq \frac{1}{2\sqrt{\pi f \mu \kappa}}$$

where f=frequency of the a.c. current flowing through the induction coil $\mu$=magnetic permeability $\kappa$=specific electrical conductivity.

The side of the second part which faces the material to be melted (the side opposite the first part) may have a layer of material on it which prevents alloying of the material to be melted. The layer preferably has a thermal conductivity of less than $2\times10^6$ mho/m.

The induction coil is preferably made of a material with a high electrical conductivity. It preferably has a rectangular cross-section with round-off radii r at the corners which satisfy the requirement that $$r \geqq 2\delta$$

where $$\delta = \frac{1}{\sqrt{\pi f \mu_0 \kappa}}$$

$\delta$=measure of penetration $\kappa$=specific electrical conductivity f=frequency of the a.c. current flowing through the induction coil $\mu_0$=magnetic permeability.

BRIEF DESCRIPTION OF THE DRAWINGS

Embodiment examples are represented in the drawing and are described below in greater detail. Therein show FIG. 1 a water-cooled crucible with a crucible wall constructed of segments.

DETAILED DESCRIPTION OF THE PREFERRED EMBODIMENTS

Figure 1:
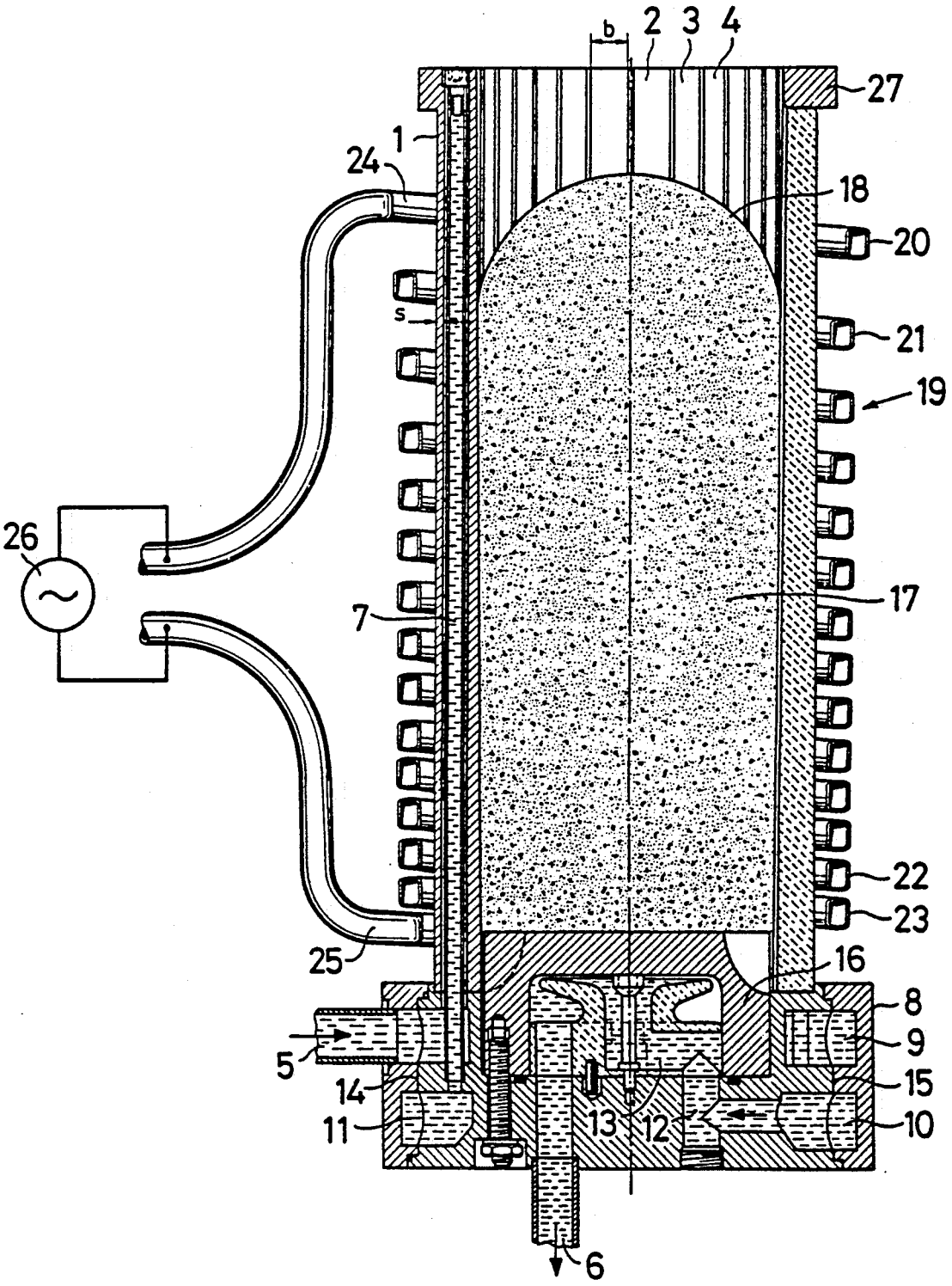

FIG. 1 shows a crucible 1 comprising several vertical segments of which three segments are provided with the reference numbers 2, 3, 4. The crucible 1 has a coolant inlet opening 5 and a coolant outlet opening 6. As coolant water is preferably used. However, it is possible to use liquid salt for example $NaNO_2$, $NaNO_3$ or $KNO_3$. The coolant flows in coaxial pipes 7 located in the segments 2, 3, 4. The individual pipes, of which in FIG. 1 only the pipe 7 can be seen, are connected, with their outer regions in parallel to the coolant inlet opening 5 and with their central regions for the coolant runback, with the coolant outlet opening 6. By 8 is denoted an intermediate ring, adjoined to a cooling channel 9, which is connected to the inlet 5. By 10, 11 is denoted a collecting channel into which streams the coolant running back. The coolant for cooling the base of the crucible is denoted by 13. The intermediate ring 8 abuts an interior body which is made clear by the separating lines 14, 15. 16 denotes the base of the crucible.

In the crucible 1 is located a melt material 17 which has an arched surface 18. About the crucible 1 is wrapped a hollow induction coil 19 comprising several windings 20, 21 . . . 22, 23. The ends 24, 25 of the coil 19 are connected to an a.c. current source 26 supplying a voltage with a frequency of for example 1000 to 5000 Hz.

At the upper rim of the crucible 1 is disposed a short-circuit link 27 to effect some linearization of the magnetic field gradient. Such linearization is required because the coil 19 stops abruptly at its upper end, the far field however, decreases only slowly. Thereby that the field incidence over the margin of the crucible is strongly reduced by means of the short-circuit link or ring 27, a field attenuation in the region of the melt surface 18 results and consequently a limiting of the bath superelevation. The short-circuit ring 27 rests on the segments 2, 3, 4 and is connected with them.

The cross section of the coil 19 is rectangular and has a rounding-off of approximately $r \geqq 2\delta$ at the corners where $$\delta = \frac{1}{\sqrt{\pi f \mu_o \kappa}}$$

is the measure of penetration and where $\kappa$ = specific electrical conductivity f = frequency of the a.c. current flowing through the induction coil $\mu_0$ = magnetic permeability As material for the coil one having high electrical conductivity is selected, for example copper or silver. Due to its rectangular configuration the coil 19 lies very close against the crucible 1 so that the energy transmission losses are low. The disadvantages resulting from the corners in rectangular coils due to large magnetic field strengths and large current density connected thereto are avoided through the rounded-off corners. The magnetic a.c. field strengths which are always linked with an electric field which generates current in the edges are, due to the rounding-off, conducted gently through the crucible wall into the melt.

Figure 2:
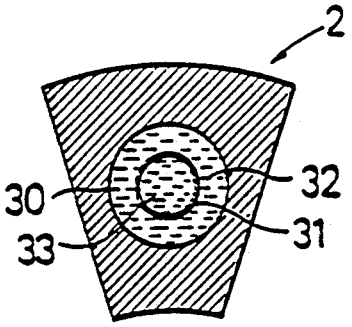
FIG. 2 a segment of a water-cooled crucible.
Figure 3:
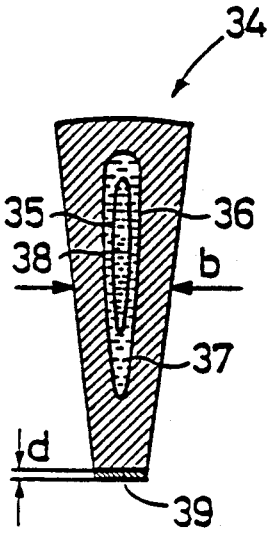
FIG. 3 a second crucible segment structured according to the invention.

In FIG. 2 is represented a segment, for example the segment 2, of a conventional cooled copper crucible in a view from above. The quasi-trapezoidal cross section of segment 2 in which is disposed a coaxial cooling pipe can be seen herein. The outer wall 30 of this cooling pipe can be formed by the wall of a recess in segment 2 which is comprised of copper. The central region of the cooling pipe is formed by a pipe 31. The coolant 32 streams upward between the inner pipe 31 and the wall 30 and downward in pipe 31 while the still cool coolant 32 in direct contact with segment 2 flows upward FIG. 3 shows a segment 34 according to the invention with a coaxial cooling pipe formed of an inner wall 35 and an outer wall 36. The conditions of flow of the coolant 37, 38 are as shown in Segment 2 of FIG. 2. Width b of segment 34 is herein so selected that the equation $$\kappa < 2/(\pi f \mu_0 b^2)$$

is satisfied, where $\kappa$ = specific electrical conductivity f = frequency of the a.c. current flowing through the induction coil 19

$\mu_o$ = *magnetic permeability in vacuo* b = width of segment b

The electrical conductivity $\kappa$ herein shall be small to avoid eddy currents.

The segment 34 is hence layed out in a manner similar to the laminations in transformers. For better heat distribution of the heat flow from the melt a thermally good conducting layer 39 comprised for example of copper is disposed at the lower end of segment 34 facing the melt. The thermally good conducting layer preferably has a heat conductivity of at least 80 Watt/m °K. A thermally good conducting layer according to the Wiedemann-Franz Law is also an electrically good conducting layer; additional electrical losses, however, are generated through this layer. The thickness d of this layer should therefore be thinner than the measure of penetration of this material. The thickness should satisfy the following equation:

$$t \leqq \frac{1}{2\sqrt{\pi f \mu \kappa}}$$

where f = frequency of the a.c. current flowing through the induction coil $\mu$ = magnetic permeability $\kappa$ = specific electrical conductivity.

Its minimum thickness—for averaging the heat flow from the solidification layer of the melt contacting only spot-wise on the crucible wall—is a function of the density of the contact spots (number of spots per inch) and the heat conductivity of the melt material. The thickness of the contact spots is a function of a number of physical parameters of the melt such as surface tension, shrinking (coefficient of expansion) at the transition solid-liquid etc.

Given the complexity of the physical relations and the specific process requirements the density of the contact spots for the different alloys of the melt cannot be calculated. It can only be determined experimentally for the particular alloy paliney of the materials to be melted because only in rare cases is a crucible used for only one alloy.

In some cases will suffice layers of 5 $\mu$m of copper or other materials which are good heat conductors. However, for the majority of alloys layer thicknesses of 100 to 500 $\mu$m will represent a sensible compromise between the reduction of the eddy current losses and the risk that local melting-on occurs.

Figure 4:
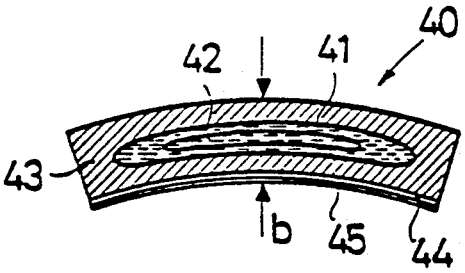
FIG. 4 a third crucible segment structured according to the invention.

FIG. 4 shows a further embodiment of the invention in which one segment 40 is of greater width than height. Here, too, a coaxial cooling pipe 41, 42 is provided. The outer area 43 of this segment is comprised of an electrically poor conductor, for example VA-steel, CrNi a metal-ceramic composite, glass, a fiber-reinforced material, or ceramic, while the interior layer 44 is comprised of an electrically good conductor, such as aluminum, silver or copper. Width b herein is actually the height which results from the fact that with b is meant not the width or the height but rather the thinnest site. Below layer 44 is located a further layer 45 which is very thin and is comprised of a material preventing a partial alloying of the melt. This material is selected in accordance with the particular melt present at the time. This is a material which in the two-substance system formed from the melt and the material itself does not form a low-melting mixture which is lower than 200 degrees Celsius below the melting limit of both materials. This layer preferably has a electrical conductivity of less than $2\times10^6$ mho/m.

Figure 5:
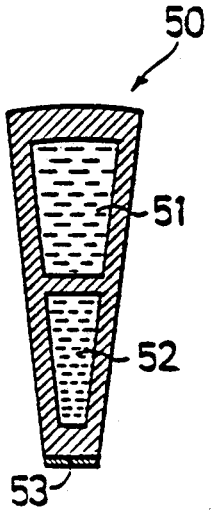
FIG. 5 a fourth crucible segment structured according to the invention.

In FIG. 5 a further segment 50 is represented in which two channels 51, 52 are provided The cooling liquid flows from channel 51 into the plane of the drawing and in the cooling channel 52 out of the plane of the drawing. This segment 50 also is provided with a good conducting layer 53.

Figure 6:
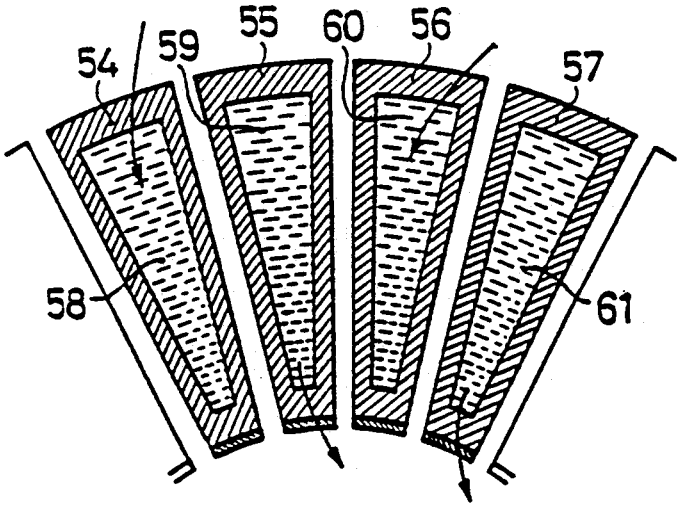
FIG. 6 a fifth crucible sector comprising several segments structured according to the invention.

FIG. 6 shows several segments 54 to 57 adjacent one to another with channels 58 to 61. Herein the cooling liquid flows into the channels 58 and 60 and out of channels 59, 61.

Figure 7:
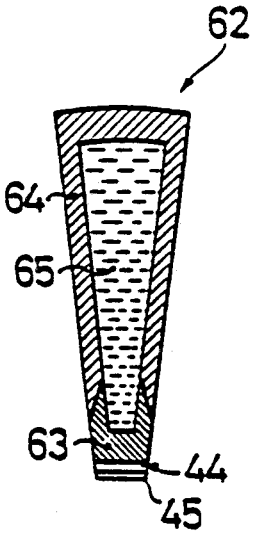
FIG. 7 a segment with an M-shaped conductor and a non-conductor disposed thereon.

FIG. 7 shows a further embodiment of a segment 62 according to the invention in which only an M-shaped copper part 63 and for example a ceramic part 64 are still provided The two parts 63, 64 are connected with each other and a cooling liquid 65 flows through their interior. The copper part 63 faces the melt It is understood that the additional layer 45 according to FIG. 4 can also be provided for the segments 2, 34, 50, 54 to 57 and 65.

Since the melt in some operating states can also penetrate slightly into the gaps between the segments and since the edges already for reasons of fabrication are rounded-off or beveled it is of advantage to allow the layers to extend slightly around the edges into the side faces.

For reduction of the danger of partial alloying on the surface, primarily with melts which suddenly partially attach, a metallic surface layer is preferably provided on the crucible segment surfaces facing the melt which form no low-melting eutectic with the melt, for example Cr or Zr. The surface layer can be applied in different methods, for example, by plating, coating, spraying, sputtering, vapor depositon or immersion.

I claim:

1. A crucible for the induction heating of materials, which comprises:

a plurality of vertical segments having at least two parts with different conductivity, a first part facing away from the material which is made of an electrically poor conductor, and a second part facing toward the material which is made of an electrically good conductor, in which the thickness of the vertical segment satisfies the equation:

$$\kappa < \frac{2}{\pi f \mu_0 b^2}$$

where $\kappa$=specific electrical conductivity of the first part f=frequency of the a.c. current flowing through the induction coil $\mu_0$=magnetic permeability in vacuo b=thickness of the vertical segment; and an induction coil wrapped around the vertical segments.

2. A crucible as in claim 1, wherein the first part is made of a non-conductor.

3. A crucible as in claim 2, wherein the first part is made of a metal-ceramic composite.

4. A crucible as in claim 1, wherein the second part is made of a substance having a heat conductivity of at least 80 Watt/m °K.

5. A crucible as in claim 1 further comprising a layer made of a substance which prevents the partial alloying of the material, the layer being attached to the side of the second part opposite the first part.

6. A crucible as in claim 4 wherein the thickness of the second part is $$t \leqq \frac{1}{2\sqrt{\pi f \mu \kappa}}$$

where f=frequency of the a.c. current flowing through the induction coil $\mu$=magnetic permeability $\kappa$=specific electrical conductivity.

7. A crucible as in claim 1, wherein the first part is made of a substance selected from the group consisting of glass, fiber-reinforced material, and ceramic.

8. A crucible as in claim 1 further comprising coaxial cooling pipes located within the vertical segments.

9. A crucible as in claim 1 further comprising a coaxial cooling system wherein the vertical segments form the outer wall of the coaxial cooling system.

10. A crucible as in claim 5 wherein the layer has an electrical conductivity of less than $2\times10^6$ mho/m.

11. A crucible as in claim 1 wherein the induction coil is made of a substance with a high electrical conductivity and has a rectangular cross section with round-off radii r at the corners which satisfy the requirement that $$r \geqq 2\delta$$

where $$\delta = \frac{1}{\sqrt{\pi f \mu_0 \kappa}}$$

where $\delta$=measure of penetration $\kappa$=specific electrical conductivity f=frequency of the a.c. current flowing through the induction coil $\mu_0$=magnetic permeability.

* * * * *